US010480769B2

(12) United States Patent
Luo et al.

(10) Patent No.: US 10,480,769 B2
(45) Date of Patent: Nov. 19, 2019

(54) LED LAMP, OVEN, AND MICROWAVE OVEN

(71) Applicant: SHENZHEN H&T INTELLIGENT CONTROL CO., LTD., Shenzhen (CN)

(72) Inventors: Chenyang Luo, Shenzhen (CN); Yinan Zhao, Shenzhen (CN); Xinhua Jiang, Shenzhen (CN); Xixian Zhuang, Shenzhen (CN)

(73) Assignee: SHENZHEN H&T INTELLIGENT CONTROL CO., LTD., Shenzhen (CN)

( * ) Notice: Subject to any disclaimer, the term of this patent is extended or adjusted under 35 U.S.C. 154(b) by 2 days.

(21) Appl. No.: 15/885,943

(22) Filed: Feb. 1, 2018

(65) Prior Publication Data

US 2018/0156443 A1 Jun. 7, 2018

Related U.S. Application Data

(63) Continuation of application No. PCT/CN2016/100341, filed on Sep. 27, 2016.

(30) Foreign Application Priority Data

Jul. 29, 2016 (CN) ..... 2016 1 0613730

(51) Int. Cl.
*F21V 29/83* (2015.01)
*F24C 15/00* (2006.01)
(Continued)

(52) U.S. Cl.
CPC ..... *F21V 29/83* (2015.01); *F21V 17/164* (2013.01); *F21V 29/10* (2015.01); *F21V 29/15* (2015.01);
(Continued)

(58) Field of Classification Search
CPC .... F21V 33/0044; F21V 29/83; F21V 29/505; F21V 29/15; F21V 7/10; H05B 6/6444; A21B 3/10; F24C 15/008
(Continued)

(56) References Cited

U.S. PATENT DOCUMENTS 6,024,469 A * 2/2000 Greif ..... F21V 7/09 362/278
9,371,966 B2 * 6/2016 Rowlette, Jr. ..... F21K 9/00
(Continued)

FOREIGN PATENT DOCUMENTS

CN 202938155 U 5/2013
CN 203586319 U 5/2014
(Continued)

OTHER PUBLICATIONS

Machine translation of Yan et al., CN 204704702U, published Oct. 14, 2015 (Year: 2015).*
(Continued)

*Primary Examiner* — William N Harris
(74) *Attorney, Agent, or Firm* — IPro, PLLC

(57) ABSTRACT

An LED lamp includes: a heat sink; a light-emitting module positioned on the heat sink, the light-emitting module including an LED unit positioned on the heat sink, a reflection cup, and a first diffuser covering the reflection cup, the reflection cup encircling the LED unit and defining at least one first ventilation hole; a heat-conducting support positioned on the heat sink and encircling the reflection cup, the heat-conducting support defining at least one second ventilation hole; and a second diffuser secured to and clamped by the heat-conducting support.

13 Claims, 3 Drawing Sheets

(51) Int. Cl.

| | |
|---|---|
| ***F21V 29/505*** | (2015.01) |
| ***F21V 29/10*** | (2015.01) |
| ***F21V 29/15*** | (2015.01) |
| ***F21V 17/16*** | (2006.01) |
| ***F21V 33/00*** | (2006.01) |
| ***H05B 6/64*** | (2006.01) |
| ***F21W 131/307*** | (2006.01) |
| ***F21Y 115/10*** | (2016.01) |
| ***F21V 3/00*** | (2015.01) |
| ***F21V 7/04*** | (2006.01) |

(52) U.S. Cl.
CPC ..... *F21V 29/505* (2015.01); *F21V 33/0044* (2013.01); *F24C 15/006* (2013.01); *F24C 15/008* (2013.01); *H05B 6/6444* (2013.01); *F21V 3/00* (2013.01); *F21V 7/041* (2013.01); *F21W 2131/307* (2013.01); *F21Y 2115/10* (2016.08)

(58) Field of Classification Search
USPC ..... 362/92
See application file for complete search history.

(56) References Cited

U.S. PATENT DOCUMENTS

| | | | | |
|---|---|---|---|---|
| 2009/0316385 | A1 | 12/2009 | Weber et al. | |
| 2011/0149552 | A1* | 6/2011 | Atalay | F24C 15/008 362/92 |
| 2012/0170247 | A1* | 7/2012 | Do | H05B 6/6444 362/92 |
| 2017/0045188 | A1* | 2/2017 | Im | F21V 29/00 |
| 2017/0059143 | A1* | 3/2017 | Baumeister | F21V 29/503 |

FOREIGN PATENT DOCUMENTS

| | | | |
|---|---|---|---|
| CN | 204704702 | U | 10/2015 |
| CN | 204879814 | U | 12/2015 |
| CN | 204943207 | U | 1/2016 |
| CN | 205897065 | U | 1/2017 |

OTHER PUBLICATIONS

Machine translation of Luo et al., CN 204879814U, published Dec. 16, 2015 (Year: 2015).*
International Search Report dated Mar. 1, 2017; PCT/CN2016/100341.

* cited by examiner

LED LAMP, OVEN, AND MICROWAVE OVEN

CROSS-REFERENCE TO RELATED APPLICATIONS

This application is a continuation of International Application No. PCT/CN2016/100341, with an international filing date of Sep. 27, 2016, which is based upon and claims priority to Chinese Patent Application No. 201610613730.8, filed with the Chinese Patent Office on Jul. 29, 2016, titled "LED LAMP, OVEN, AND MICROWAVE OVEN," the entire contents of which are incorporated herein by reference.

TECHNICAL FIELD

The present disclosure relates to the field of LED lighting technology, and particularly, to an LED lamp, oven, and microwave oven.

BACKGROUND

With advantages of energy conservation, environmental friendliness, and long service life, light emitting diodes (LEDs), in most lighting areas, have gradually taken the place of conventional light sources including incandescent light bulbs and halogen lamps which have high energy consumption and short service life. Household appliances such as ovens and microwave ovens require lighting function, but the chamber of the household appliances has a high temperature during working, so it is necessary to substitute LED light sources for conventional light sources.

However, the substitution encounters the following difficulties. LED light sources are cold light sources, and the chips and encapsulating materials thereof are not high temperature resistant, so when the LED light sources are used to substitute for conventional light sources of ovens and microwave ovens, they tend to be damaged in high temperature environment.

SUMMARY

The present disclosure provides an LED lamp, oven, and microwave oven that can effectively separate the heat in the oven or microwave oven from an LED unit, so that the LED unit can work under proper environment temperatures, thus prolonging the service life of the LED lamp.

To solve the above problems, an embodiment of the present disclosure provides an LED lamp, which includes:

a heat sink;

a light-emitting module positioned on the heat sink, the light-emitting module including an LED unit positioned on the heat sink, a reflection cup, and a first diffuser covering the reflection cup, the reflection cup encircling the LED unit and defining at least one first ventilation hole;

a heat-conducting support positioned on the heat sink and encircling the reflection cup, the heat-conducting support defining at least one second ventilation hole; and a second diffuser secured to and clamped by the heat-conducting support.

Wherein, the reflection cup is trumpet-shaped and includes a small opening end and a large opening end which are disposed oppositely, and the first ventilation hole is located in the vicinity of the small opening end.

Wherein, the large opening end of the reflection cup protrudes outwards to form at least two clamping parts, and the first diffuser is clamped in the at least two clamping parts.

Wherein, the heat-conducting support protrudes outwards to form at least two ear parts, and the at least two ear parts are connected to the heat sink.

Wherein, the second diffuser is in threaded connection to the heat-conducting support.

Wherein, the LED lamp includes a thermal insulation element positioned on the heat sink, and the heat-conducting support is connected to the thermal insulation element.

Wherein, the LED lamp includes a thermal insulation sealing ring which is sandwiched between the heat-conducting support and the second diffuser.

Wherein, the LED unit includes a PCB attached to the heat sink and an LED chip electrically connected to the PCB, and one side of the PCB is attached to the heat sink and is coated with a heat-conducting layer.

In accordance with another embodiment, the present disclosure provides an oven including a box and the abovementioned LED lamp, and the LED lamp is embedded in the box.

In accordance with still another embodiment, the present disclosure provides a microwave oven including a box and the abovementioned LED lamp, and the LED lamp is partially embedded in the box.

embedding the LED lamp in the microwave oven or oven, most of the heat in the microwave oven or oven is transferred to the air outside of the box of the microwave oven or oven via the convection and/or radiation between the second diffuser and the heat-conducting support. The heat in the chamber formed by the reflection cup and the first diffuser is dissipated to the air via the first ventilation hole and the second ventilation hole, achieving the heat balance, and the heat produced by the LED unit is transferred to the heat sink, as a result, the heat in the microwave oven or oven is separated from the LED unit, the LED unit can work at proper ambient temperature, thus prolonging the service life of the LED lamp.

DETAILED DESCRIPTION

As shown in FIGS. 1-4, one embodiment of the present disclosure provides a microwave oven 11 including an LED lamp 100 and a box 200, and the LED lamp 100 is partially embedded in the box 200.

Figure 1:
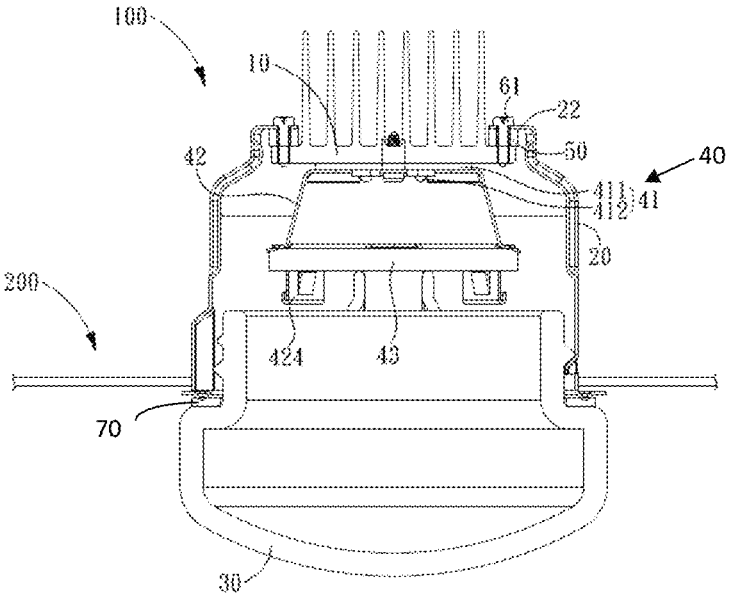
FIG. 1 is a partial sectional view of a microwave oven according to one embodiment of the present disclosure.

As shown in FIG. 1, the LED lamp 100 includes: a heat sink 10, a light-emitting module 40 positioned on the heat sink 10, a heat-conducting support 20 positioned on the heat sink 10, and a second diffuser 30 secured to and clamped by the heat-conducting support 20. In some embodiments, the box 200 defines mounting holes for fixing the LED lamp 100, and the heat-conducting support 20 butts against the hole wall of the mounting holes.

The light-emitting module 40 includes: an LED unit 41, a reflection cup 42, and a first diffuser 43.

The LED unit 41 is positioned on the heat sink 10. In the present embodiment, the LED unit 41 includes a Printed Circuit Board (PCB) 411 closely attached to the heat sink 10 and an LED chip 412 electrically connected to the PCB 411, for example, the LED chip 412 is attached to the PCB 411, or the LED chip 412 is inserted in the PCB 411. To facilitate the heat released from the electronic components assembled on the PCB 411 to transfer to the heat sink 10 via the PCB 411, one side of the PCB 411 is closely attached to the heat sink 10 and is coated with a heat-conducting layer, for example, the heat-conducting layer is a heat-conducting silica gel layer.

Figure 2:
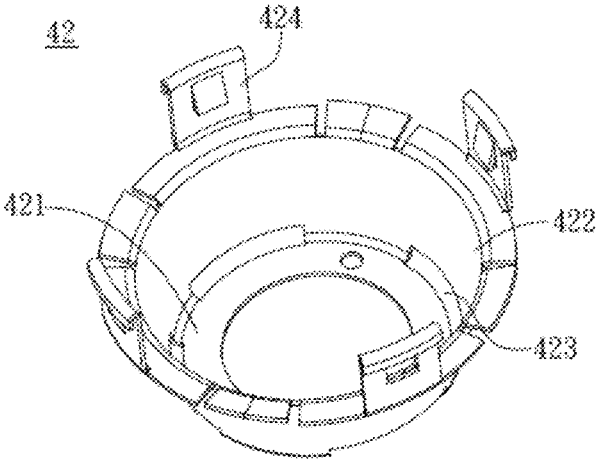
FIG. 2 is a schematic diagram of a reflection cup according to one embodiment of the present disclosure.

The reflection cup 42 is positioned on the heat sink 10 and encircles the LED unit 41. The first diffuser 43 covers the reflection cup 42, so that the heat sink 10, the reflection cup 42, and the first diffuser 43 form a chamber in which the LED unit 41 is positioned. In the embodiment of the present disclosure, as shown in FIG. 2, the reflection cup 42 is trumpet-shaped and includes a small opening end 421 and a large opening end 422 which are disposed oppositely, and the aperture of the small opening end 421 is smaller than the aperture of the large opening end 422. The small opening end 421 of the reflection cup 42 is position on the heat sink 10. The reflection cup defines at least one first ventilation hole 423, and the at least one first ventilation hole 423 is located in the vicinity of the small opening end 421 of the reflection cup 42. The first diffuser 43 is located in the vicinity of the large opening end 422 of the reflection cup 42. The material of the first diffuser 43 is but not limited to transparent glass, transparent resin, or the like.

To facilitate the disassembly and assembly of the first diffuser 43, the large opening end 422 of the reflection cup 42 protrudes outwards to form at least two clamping parts 424, and the first diffuser 43 is clamped in the at least two clamping parts 424. In the embodiment of the present disclosure, there are four clamping parts 424 which are uniformly distributed on the large opening end 422 of the reflection cup 42, and the first diffuser 43 is clamped among the four clamping parts 424.

In some embodiments, the reflection cup 42 includes an embedded reflector made of diffuse reflective material having high reflectivity, which is conducive to gathering light emitted from the LED chip 412, thus increasing the light utilization efficiency.

Figure 3:
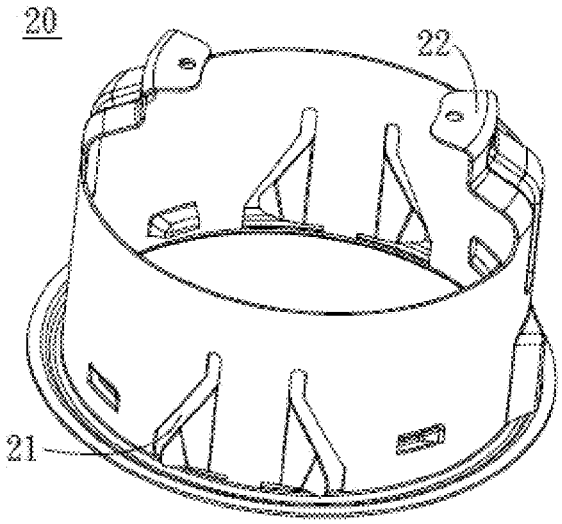
FIG. 3 is a schematic diagram of a heat-conducting support according to one embodiment of the present disclosure.
Figure 4:
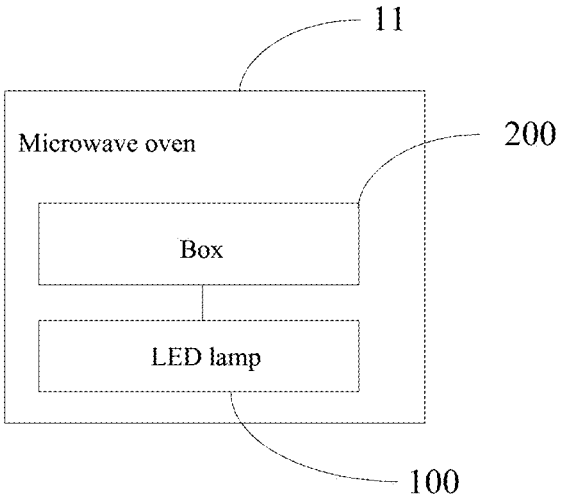
FIG. 4 is a structure diagram of a microwave oven according to one embodiment of the present disclosure.

The heat-conducting support 20 encircles the reflection cup 42. In the embodiment of the present disclosure, the heat-conducting support 20 may be a metal support with good heat transfer effect, or a nonmetal support with good heat transfer effect. To reduce the heat transfer between the heat-conducting support 20 and the heat sink 10, the LED lamp 100 includes a thermal insulation element 50 fixed on the heat sink 10, and the heat-conducting support 20 is fixedly connected to the thermal insulation element 50. In some embodiments, as shown in FIG. 3, the heat-conducting support 20 defines at least one second ventilation hole 21, and the heat-conducting support 20 protrudes outwards to form at least two ear parts 22. Threaded fasteners 61 such as screws and bolts run through the ear parts 22 and the thermal insulation element 50 sequentially to fix the heat-conducting support 20 on the heat sink 10.

The second diffuser 30 covers the heat-conducting support 20. In the embodiment of the present disclosure, the material of the second diffuser 30 is but not limited to transparent glass, transparent resin, or the like. The second diffuser 30 is in threaded connection to the heat-conducting support 20. To effectively prevent the heat from entering the chamber formed by the heat-conducting support 20 and the second diffuser 30 via the gap at the joint of the heat-conducting support 20 and the second diffuser 30, the LED lamp includes a thermal insulation sealing ring 70 which is sandwiched between the heat-conducting support 20 and the second diffuser 30, thus eliminating the adverse effect of the heat on the LED unit 41.

Through embedding partial of the LED lamp 100 in the box 200 of the microwave oven 11, most of the heat in the microwave oven 11 is transferred to the air outside of the box 200 of the microwave oven 11 via the convection and/or radiation between the second diffuser 30 and the heat-conducting support 20. The heat in the chamber formed by the reflection cup 42 and the first diffuser 43 is dissipated to the air via the first ventilation hole 423 and the second ventilation hole 21, achieving the heat balance, and the heat produced by the LED unit 41 is transferred to the heat sink 10, as a result, the heat in the microwave oven is separated from the LED unit 41, the LED unit 41 can work at proper ambient temperature, thus prolonging the service life of the LED lamp 100.

Figure 5:
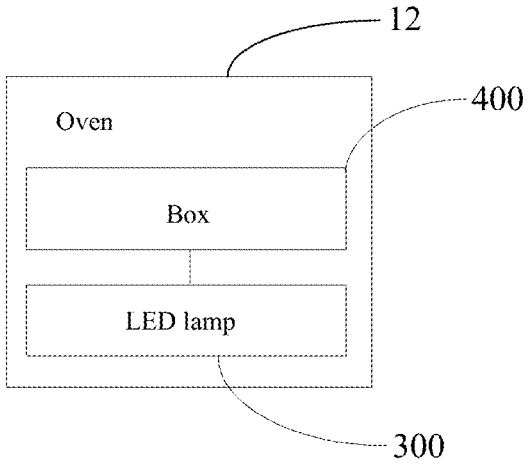
FIG. 5 is a structure diagram of an oven according to one embodiment of the present disclosure.

Undoubtedly, the LED lamp in the embodiment of the present disclosure can be applied to other household appliances, for example, ovens. As shown in FIG. 5, another embodiment of the present disclosure provides an oven 12 including an LED lamp 300 and a box 400, and the LED lamp 300 is positioned on the box 400 and partial of the LED lamp 300 is embedded in the box 400. The structure and the usage method of the LED lamp 300 are the same as that of the LED lamp illustrated in FIGS. 1-3, and the structure and the usage method of the box 400 are the same as that of the box illustrated in FIGS. 1-3.

Through embedding partial of the LED lamp 300 in the box 400 of the oven 12, the heat in the oven 12 is separated from the LED unit of the oven, thus avoiding high operating ambient temperature of the LED unit, and prolonging the service life of the LED lamp 300.

Finally it shall be noted that, the above embodiments are only used to describe but not to limit the technical solutions of the present disclosure; and within the concept of the present disclosure, technical features of the above embodiments or different embodiments may also be combined with each other, the steps may be implemented in an arbitrary order, and many other variations in different aspects of the present disclosure described above are possible although, for purpose of simplicity, they are not provided in the details. Although the present disclosure has been detailed with reference to the above embodiments, those of ordinary skill in the art shall appreciate that modifications can still be made to the technical solutions disclosed in the above embodiments or equivalent substations may be made to some of the technical features, and the corresponding technical solutions will not depart from the scope of the present disclosure due to such modifications or substations.

What is claimed is:

1. An LED lamp, comprising:

a heat sink;

a light-emitting module positioned on the heat sink, the light-emitting module comprising an LED unit positioned on the heat sink, a reflection cup, and a first diffuser covering the reflection cup, the reflection cup encircling the LED unit and defining at least one first ventilation hole;

a heat-conducting support positioned on the heat sink and encircling the reflection cup, the heat-conducting support defining at least one second ventilation hole; and a second diffuser secured to and clamped by the heat-conducting support;

the first ventilation hole and the second ventilation hole connected, such that heat in a chamber formed by the reflection cup and the first diffuser is dissipated to air outside the LED lamp via the first ventilation hole and the second ventilation hole;

wherein the heat-conducting support protrudes outwards to form at least two ear parts, and the at least two ear parts are connected to the heat sink;

the LED lamp comprises a thermal insulation element positioned on the heat sink, and the heat-conducting support is connected to the thermal insulation element, threaded fasteners run through the ear parts and the thermal insulation element sequentially to fix the heat-conducting support on the heat sink.

2. The LED lamp of claim 1, wherein the reflection cup is trumpet-shaped and comprises a small opening end and a large opening end which are disposed oppositely, and the first ventilation hole is located in the vicinity of the small opening end.

3. The LED lamp of claim 2, wherein the large opening end of the reflection cup protrudes outwards to form at least two clamping parts, and the first diffuser is clamped in the at least two clamping parts.

4. The LED lamp of claim 1, wherein the second diffuser is in threaded connection to the heat-conducting support.

5. The LED lamp of claim 1, wherein the LED lamp comprises a thermal insulation sealing ring which is sandwiched between the heat-conducting support and the second diffuser.

6. The LED lamp of claim 1, wherein the LED unit comprises a PCB attached to the heat sink and an LED chip electrically connected to the PCB, and one side of the PCB is attached to the heat sink and is coated with a heat-conducting layer.

7. An oven, comprising a box and an LED lamp, wherein the LED lamp is partially embedded in the box; the LED lamp comprising:

a heat sink;

a light-emitting module positioned on the heat sink, the light-emitting module comprising an LED unit positioned on the heat sink, a reflection cup, and a first diffuser covering the reflection cup, the reflection cup encircling the LED unit and defining at least one first ventilation hole;

a heat-conducting support positioned on the heat sink and encircling the reflection cup, the heat-conducting support defining at least one second ventilation hole; and a second diffuser secured to and clamped by the heat-conducting support;

the first ventilation hole and the second ventilation hole connected, such that heat in a chamber formed by the reflection cup and the first diffuser is dissipated to air outside the LED lamp via the first ventilation hole and the second ventilation hole;

wherein the reflection cup is trumpet-shaped and comprises a small opening end and a large opening end which are disposed oppositely, and the first ventilation hole is located between a wall of the reflection cup and the small opening end;

wherein the heat-conducting support protrudes outwards to form at least two ear parts, and the at least two ear parts are connected to the heat sink;

the LED lamp comprises a thermal insulation element positioned on the heat sink, and the heat-conducting support is connected to the thermal insulation element, threaded fasteners run through the ear parts and the thermal insulation element sequentially to fix the heat-conducting support on the heat sink.

8. The oven of claim 7, wherein the large opening end of the reflection cup protrudes outwards to form at least two clamping parts, and the first diffuser is clamped in the at least two clamping parts.

9. The oven of claim 7, wherein the LED lamp comprises a thermal insulation sealing ring which is sandwiched between the heat-conducting support and the second diffuser.

10. A microwave oven, comprising a box and an LED lamp, wherein the LED lamp is partially embedded in the box; the LED lamp comprising:

a heat sink;

a light-emitting module positioned on the heat sink, the light-emitting module comprising an LED unit positioned on the heat sink, a reflection cup, and a first diffuser covering the reflection cup, the reflection cup encircling the LED unit and defining at least one first ventilation hole;

a heat-conducting support positioned on the heat sink and encircling the reflection cup, the heat-conducting support defining at least one second ventilation hole; and a second diffuser secured to and clamped by the heat-conducting support;

the first ventilation hole and the second ventilation hole connected, such that heat in a chamber formed by the reflection cup and the first diffuser is dissipated to air outside the LED lamp via the first ventilation hole and the second ventilation hole;

wherein the heat-conducting support protrudes outwards to form at least two ear parts, and the at least two ear parts are connected to the heat sink;

the LED lamp comprises a thermal insulation element positioned on the heat sink, and the heat-conducting support is connected to the thermal insulation element, threaded fasteners run through the ear parts and the thermal insulation element sequentially to fix the heat-conducting support on the heat sink.

11. The microwave oven of claim 10, wherein the reflection cup is trumpet-shaped and comprises a small opening end and a large opening end which are disposed oppositely, and the first ventilation hole is located in the vicinity of the small opening end.

12. The microwave oven of claim 11, wherein the large opening end of the reflection cup protrudes outwards to form at least two clamping parts, and the first diffuser is clamped in the at least two clamping parts.

13. The microwave oven of claim 10, wherein the LED lamp comprises a thermal insulation sealing ring which is sandwiched between the heat-conducting support and the second diffuser.

* * * * *